US009980344B2

(12) United States Patent
Kimura et al.

(10) Patent No.: US 9,980,344 B2
(45) Date of Patent: May 22, 2018

(54) LUMINAIRE

(71) Applicant: Panasonic Intellectual Property Management Co., Ltd., Osaka (JP)

(72) Inventors: Yuki Kimura, Osaka (JP); Toshikazu Kawashima, Osaka (JP); Yuichi Ejiri, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days. days.

(21) Appl. No.: 15/408,922

(22) Filed: Jan. 18, 2017

(65) Prior Publication Data

US 2017/0215250 A1 Jul. 27, 2017

(30) Foreign Application Priority Data

Jan. 21, 2016 (JP) ..... 2016-010063

(51) Int. Cl.
*H05B 37/02* (2006.01)
*H05B 33/08* (2006.01)

(52) U.S. Cl.
CPC ..... *H05B 37/0209* (2013.01); *H05B 33/0845* (2013.01); *H05B 37/0245* (2013.01)

(58) Field of Classification Search
CPC .... H05B 33/08; H05B 37/02; H05B 37/0209; H05B 37/0254; H05B 37/0272
See application file for complete search history.

(56) References Cited

U.S. PATENT DOCUMENTS

| | | | | |
|---|---|---|---|---|
| 9,655,216 | B2 * | 5/2017 | Murakami | H05B 37/0272 |
| 2013/0015785 | A1 * | 1/2013 | Kamada | H04B 10/116 315/297 |
| 2013/0069561 | A1 * | 3/2013 | Melanson | H05B 33/0815 315/297 |
| 2016/0262221 | A1 * | 9/2016 | Nishioka | H05B 33/086 |

FOREIGN PATENT DOCUMENTS

| | | | |
|---|---|---|---|
| JP | 2003-308988 | A | 10/2003 |
| JP | 2005-347645 | A | 12/2005 |
| JP | 2013-026464 | A | 2/2013 |
| JP | 2015-109196 | A | 6/2015 |
| JP | 2015-109197 | A | 6/2015 |

* cited by examiner

*Primary Examiner* — Thai Pham
(74) *Attorney, Agent, or Firm* — McDermott Will & Emery LLP

(57) ABSTRACT

A luminaire includes a light source, a terminal that receives a dimming signal indicating a dimming rate and a parameter signal including a predetermined coefficient, a storage that stores the predetermined coefficient included in the parameter signal received by the terminal, a controller that generates a control value by multiplying information based on the dimming signal received by the terminal by the predetermined coefficient stored in the storage, and a lighting circuit that causes the light source to output light at a brightness in accordance with the control value provided by the controller.

7 Claims, 6 Drawing Sheets

FIG. 3

| DIGITAL VALUE | DUTY RATIO (%) |
|---|---|
| 0 | 0 |
| 1 | 0.4 |
| 2 | 0.8 |
| ⋮ | ⋮ |
| 101 | 39.6 |
| 102 | 40 |
| ⋮ | ⋮ |
| 203 | 79.6 |
| 204 | 80 |
| ⋮ | ⋮ |
| 254 | 99.6 |
| 255 | 100 |

| PARAMETER SIGNAL | IDENTIFICATION INFORMATION | COEFFICIENT |
|---|---|---|

LUMINAIRE

CROSS REFERENCE TO RELATED APPLICATION

This application claims the benefit of priority of Japanese Patent Application Number 2016-010063 filed on Jan. 21, 2016, the entire content of which is hereby incorporated by reference.

BACKGROUND

1. Technical Field

The present disclosure relates to a luminaire capable of dimming brightness of a light source.

2. Description of the Related Art

Conventionally, luminaires in which turning ON/OFF or dimming, etc., of a light source in the luminaire is controlled using a controller provided outside the luminaire have been proposed. A technique related to such a luminaire is described in Japanese Unexamined Patent Application Publication No. 2015-109197 (Patent Literature 1).

SUMMARY

There is a demand that users want to select, from a lineup including luminaires that output light in mutually different ranges of brightness (brightness range), a luminaire that outputs light in a brightness range that suits the user. Specifically, there is a demand that users want to select a luminaire that outputs light in a brightness range (for example, 0 to 5,000 lm) that suits the user, from a lineup of luminaires having brightness (luminous flux) ranges of, for example, 0 lm to 1,000 lm, 0 lm to 2,000 lm, . . . , and 0 lm to 10,000 lm.

However, in order to realize a lineup including luminaires that output light in mutually different brightness ranges, it is necessary to develop power supply blocks compatible with the brightness range of each of the luminaires. This increases development workload and complicates power supply block part number management at the manufacturing plant, thus increasing luminaire manufacturing cost.

In view of this, the present disclosure provides a luminaire that facilitates the realization of a lineup including luminaires that output light in mutually different brightness ranges.

A luminaire according to one or more aspects of the present disclosure includes a light source, a terminal that receives a dimming signal and a parameter signal, the dimming signal indicating a dimming rate, the parameter signal including a predetermined coefficient, a storage that stores the predetermined coefficient included in the parameter signal received by the terminal, a controller that generates a control value by multiplying information based on the dimming signal received by the terminal by the predetermined coefficient stored in the storage, and a lighting circuit that causes the light source to output light at a brightness in accordance with the control value provided by the controller.

The luminaire according to one or more aspects of the present disclosure facilitates the realization of a lineup including luminaires that output light in mutually different brightness ranges.

BRIEF DESCRIPTION OF DRAWINGS

The figures depict one or more implementations in accordance with the present teaching, by way of examples only, not by way of limitations. In the figures, like reference numerals refer to the same or similar elements.

FIG. 3 is a diagram illustrating an example of a dimming table stored in a storage according to the embodiment;

DETAILED DESCRIPTION OF THE EMBODIMENT

Hereinafter, exemplary embodiments of the present disclosure will be described in detail using the drawings. It should be noted that each of the subsequently-described exemplary embodiments shows a specific example. Therefore, numerical values, shapes, materials, structural components, the arrangement and connection of the structural components, etc. shown in the following exemplary embodiments are mere examples, and are not intended to limit the scope of the present disclosure. Furthermore, among the structural components in the following exemplary embodiments, components not recited in any one of the independent claims which indicate the broadest concepts are described as arbitrary structural components.

Furthermore, the respective figures are schematic diagrams and are not necessarily precise illustrations. In addition, in the respective figures, identical structural components are given the same reference signs.

Embodiment

Hereinafter, exemplary embodiments will be described using FIG. 1 to FIG. 7.

Figure 1:
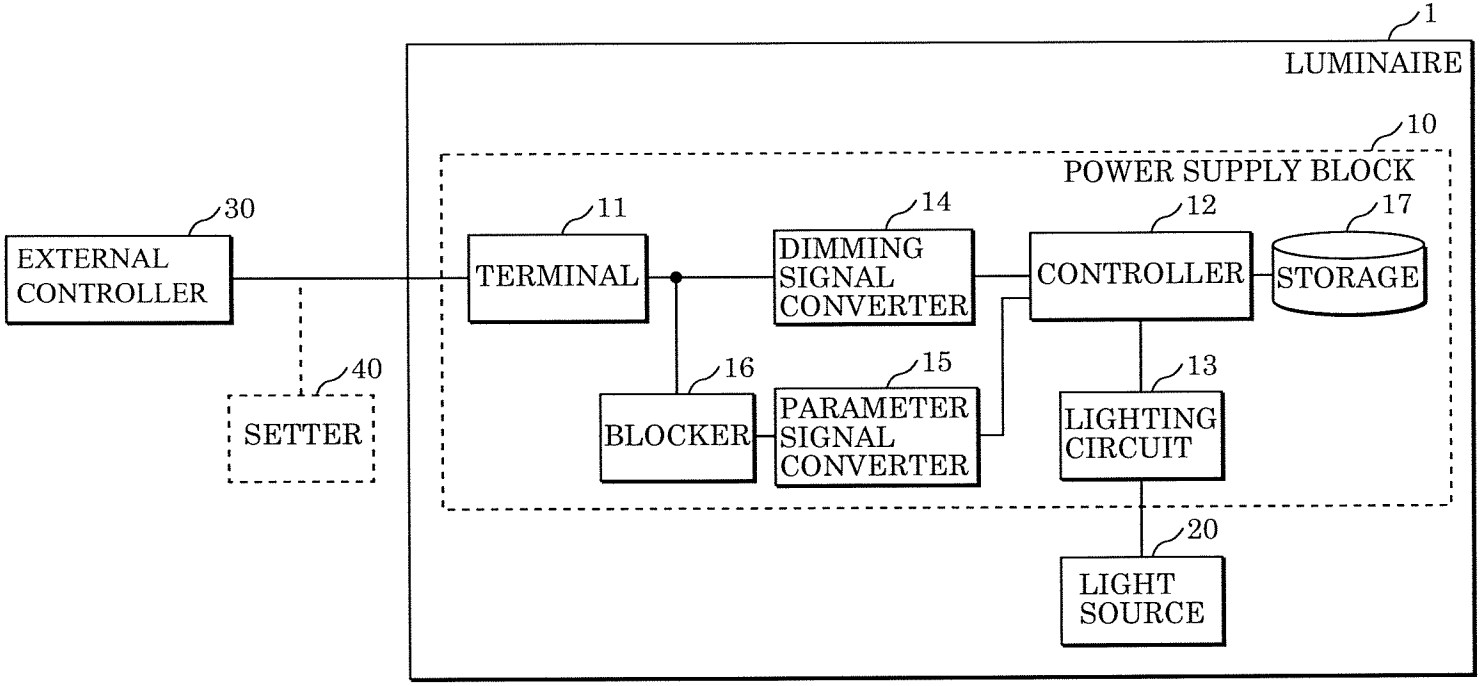
FIG. 1 is a configuration diagram illustrating an example of a luminaire according to an embodiment.

FIG. 1 is a configuration diagram illustrating an example of luminaire 1 according to an embodiment. It should be noted that FIG. 1 also illustrates controller 30 and setter 40 which are not structural components of luminaire 1.

The turning ON/OFF or dimming, etc. of light source 20 of luminaire 1 is controlled by controller 30 (an external controller) provided outside luminaire 1. Furthermore, the setting of the range of brightness (brightness range) of light that can be outputted by luminaire 1 is changed by setter 40 provided outside luminaire 1. The setting of the brightness range of luminaire 1 means, for example, setting the range of the brightness (luminous flux) of light that can be outputted by light source 20 of luminaire 1 to 0 lm to 1,000 lm, 0 lm to 2,000 lm, . . , and 0 lm to 10,000 lm, etc. Specifically, for example, luminaire 1 having a brightness range set to 0 lm to 1,000 lm can be dimmed between 0 lm to 1,000 lm, and luminaire 1 having a brightness range set to 0 lm to 10,000 lm can be dimmed between 0 lm to 10,000 lm. In this manner, luminaire 1 is a luminaire that operates based on an instruction from controller 30 or setter 40, etc. provided outside.

Luminaire 1 includes power supply block 10 and light source 20. Power supply block 10 is a power supply circuit that supplies power to light source 20, based on a signal from controller 30. Light source 20 is a light source, the brightness of which is changed according to voltage or current from power supply 10, and is, for example, a light-emitting diode (LED) or a fluorescent light, etc.

Power supply block 10 includes terminal 11, controller 12, lighting circuit 13, dimming signal converter 14, parameter signal converter 15, blocker 16, and storage 17.

Terminal 11 receives a dimming signal indicating dimming rate and a parameter signal including a predetermined coefficient. A dimming signal is a signal transmitted by controller 30, and is, for example, a pulse width modulation (PWM) signal. A parameter signal is a signal transmitted by setter 40, and is, for example, a universal asynchronous receiver transmitter (UART) signal. The predetermined coefficient included in the parameter signal is, for example, a value greater than 0 and at most 1, and is a value by which controller 12 described later, multiplies information based on a dimming signal. The waveforms of a dimming signal and a parameter signal will be described in detail using FIG. 2 described later. Terminal 11 is a terminal for receiving a dimming signal from controller 30 and a parameter signal from setter 40. Terminal 11 receives the dimming signal from controller 30 which is, for example, connected by wire to terminal 11. Furthermore, terminal 11 receives the parameter signal from setter 40 which is, for example, connected by wire to terminal 11. Setter 40 is, for example, connected to terminal 11 when the setting of luminaire 1 is carried out at the manufacturing plant prior to shipment of luminaire 1. Furthermore, controller 30 is, for example, connected to terminal 11 when dimming of luminaire 1 is to be performed in the environment (an establishment such as a home, office, etc.) in which a user uses luminaire 1 after shipment of luminaire 1. Luminaire 1 need not include terminals for connecting to each of controller 30 and setter 40, and controller 30 and setter 40 are connected to luminaire 1 using a the same terminal (terminal 11). In other words, terminal 11 which receives a signal (dimming signal) for dimming luminaire 1 also receives a signal (parameter signal) for setting luminaire 1. It should be noted that controller 30 and setter 40 may be connected to terminal 11 simultaneously.

Storage 17 is a read only memory (ROM), etc. which holds a program and data in advance, and is, for example, a nonvolatile memory such as an electrically erasable programmable read only memory (EEPROM). Storage 17 stores a predetermined coefficient included in the parameter signal received by terminal 11. Furthermore, storage 17 stores a dimming table indicating a correspondence relationship between digital values, such as 0 to 255, and duty ratios. The dimming table will be described in detail using FIG. 3 described later.

Controller 12 is, for example, a microcomputer which generates a control value by multiplying information based on the dimming signal received by terminal 11 by the predetermined coefficient stored in storage 17. Controller 12 has a communication port into which, for example, a high level or low level communication signal is inputted. Furthermore, controller 12 has, for example, an AD port which has an AD conversion function, and into which an analog voltage that is to be converted to a digital value is inputted. Control 12 performs processing for generating the control value by multiplying the information based on the dimming signal received by terminal 11 by the predetermined coefficient stored in storage 17, by executing the program stored in storage 17. Specifically, controller 12 stores the predetermined coefficient included in the parameter signal received by terminal 11 in storage 17. Then, controller 12 subsequently generates the control value by multiplying the information based on the dimming signal received by terminal 11 by the predetermined coefficient stored in storage 17, and supplies the control value to lighting circuit 13. The control value is a value that indicates the duty ratio of the voltage or current that lighting circuit 13 outputs to light source 20. The information based on the dimming signal will be described in detail using FIG. 3 described later. It should be noted that storage 17 may be a storage (for example, a memory, etc. included in a microcomputer) included in controller 12.

Furthermore, controller 12 transmits, to lighting circuit 13, a duty signal that is in accordance with the control value.

Lighting circuit 13 is a circuit which causes light source 20 to output light in accordance with the control value provided by controller 12. Specifically, lighting circuit 13 is a circuit that outputs, to light source 20, voltage or current that is in accordance with the duty signal transmitted from controller 12.

Dimming signal converter 14 is a circuit provided between terminal 11 and controller 12, and includes a smoothing circuit that smooths the dimming signal received by terminal 11. Specifically, the smoothing circuit is an RC circuit that smooths and converts a dimming signal (PWM signal) into analog voltage (see FIG. 4 and FIG. 5 described later). With this, controller 12 obtains, via the AD port, the dimming signal (analog voltage) resulting from the conversion by dimming signal converter 14.

Parameter signal converter 15 is a circuit provided in parallel with dimming signal converter 14, between terminal 11 and controller 12, and includes a switching circuit that switches according to the parameter signal received by terminal 11. Specifically, the switching circuit is a switching circuit using a transistor, etc., which converts a parameter signal (UART signal) into a waveform that can be recognized by controller 12. For example, since there are instances where a high level signal for controller 30 may not be a high level signal for controller 12, parameter signal converter 15 amplifies the parameter signal to a high level that can be recognized by controller 12. With this, controller 12 can obtain, via the communication port included in controller 12, the parameter signal that has been converted by parameter signal converter 15.

Blocker 16 is a circuit provided in parallel with dimming signal converter 14 and in series with parameter signal converter 15, between terminal 11 and parameter signal converter 15, and is a circuit that blocks a predetermined signal headed to parameter signal converter 15. Blocker 16 will be described in detail using FIG. 4 and FIG. 5 described later.

Controller 30 is, for example, a remote controller or a personal computer (PC) provided in the establishment used by the user such as a home or office, and controls the turning ON/OFF or dimming, etc., of light source 20 of luminaire 1 by way of user operation of controller 30 or a preset scheduled operation.

Setter 40 is, for example, a PC used at an establishment such as the manufacturing plant of luminaire 1, and is a device for setting the brightness range of luminaire 1. It should be noted that setter 40 may be used at the establishment used by the user such as a home or office. In other words, the brightness range of luminaire 1 may be set by the manufacturer at an establishment such as the manufacturing plant, or the brightness range of luminaire 1 may be set by the user at the establishment used by the user such as a home or office.

Next, the waveforms of the dimming signal and the parameter signal will be described using FIG. 2.

Figure 2:
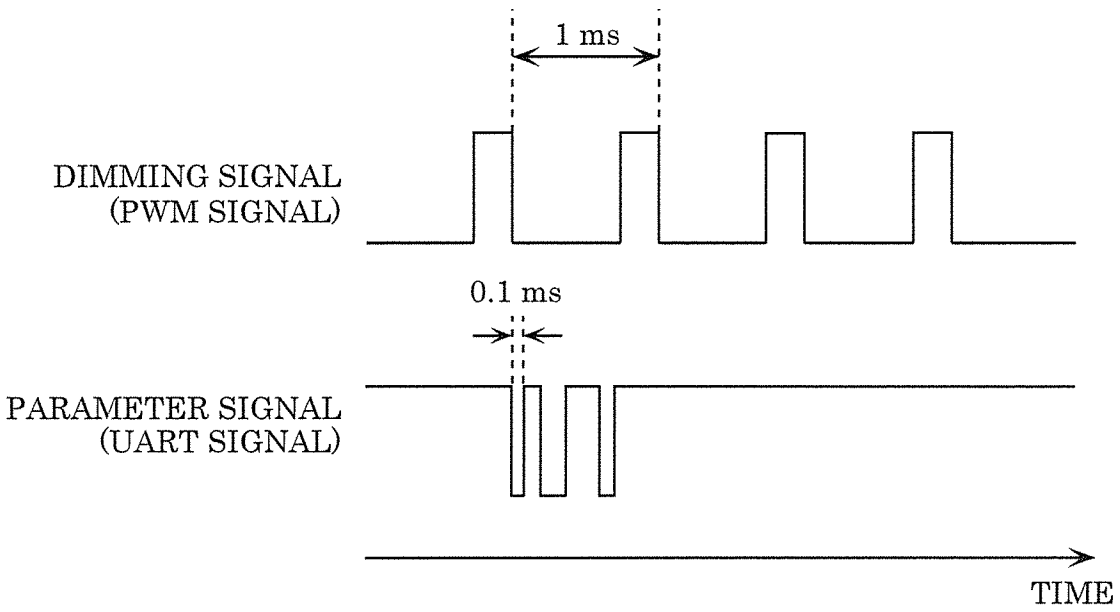
FIG. 2 is a diagram illustrating an example of waveforms of a dimming signal and a parameter signal.

FIG. 2 is a diagram illustrating an example of waveforms of a dimming signal and a parameter signal.

As illustrated in FIG. 2, the dimming signal is a PWM signal with a period of, for example, 1 ms. In other words, the dimming signal is a signal with a frequency of, for example, 1 kHz. Furthermore, the parameter signal is a UART signal in which data corresponding to 1 bit is represented by, for example, 0.1 ms. In other words, the parameter signal is a signal with a frequency of, for example, 10 kHz. In this manner, the dimming signal and the parameter signal are signals having mutually different frequencies. Luminaire 1 (controller 12) distinguishes a dimming signal and a parameter signal based on the frequencies of the dimming signal and the parameter signal. In this embodiment, the parameter signal is a signal with a higher frequency than the dimming signal.

Next, the dimming table stored by storage 17 will be described using FIG. 3.

FIG. 3 is a diagram illustrating an example of the dimming table stored by storage 17 according to this embodiment.

As illustrated in FIG. 3, the dimming table is, for example, a table in which digital values from 0 to 255 which can be represented by 8 bits and duty ratios are associated with each other. Controller 12 checks the dimming table for a digital value obtained by AD conversion of the dimming signal (analog voltage) obtained by controller 12 by the AD port. The duty ratios in the dimming table are the duty ratios (control values) indicated by the duty signals transmitted (provided) by controller 12 to lighting circuit 13. However, although details will be described later, it should be noted that there is a case where the duty ratio in the dimming table is not the duty ratio indicated by the duty signal transmitted by controller 12 to lighting circuit 13. Here, the use of the dimming table will be described.

Controller 12 converts a dimming signal (analog voltage) inputted to the AD port to a digital value, and checks for the digital value in the dimming table. For example, when the digital value converted from the analog voltage is 204, controller 12 transmits, to lighting circuit 13, the duty signal indicating the duty ratio of 80% corresponding to digital value 204 in the dimming table illustrated in FIG. 3. In addition, lighting circuit 13 causes light source 20 to light up with an 80% dimming rate. For example, in the case where the brightness of light source 20 when the duty ratio is 100% is 10,000 lm, lighting circuit 13 dims the brightness of light source 20 to 8,000 lm.

In this embodiment, controller 12 multiplies the information based on the dimming signal by the predetermined coefficient. The information based on the dimming signal is, for example, the digital value converted from the analog voltage. In the case where the digital value converted from the analog voltage is 204, controller 12 multiplies 204 by the predetermined coefficient stored in storage 17. When the predetermined coefficient is 0.5 for example, controller 12 multiplies 204 by 0.5. Then, controller 12 checks for 102 obtained by multiplying 204 by 0.5, in the dimming table. With this, controller 12 transmits a duty signal indicating a duty ratio of 40% to lighting circuit 13. Then, lighting circuit 13 causes light source 20 to light up with a 40% dimming rate.

Furthermore, the information based on the dimming signal may be, for example, a duty ratio corresponding to the digital value when controller 12 checks the dimming table for the digital value converted from the analog voltage. For example, when the digital value converted from the analog voltage is 204, controller 12 transmits, to lighting circuit 13, a duty signal indicating a 40% duty ratio obtained by multiplying the 80% duty ratio corresponding to the digital value 204 in the dimming table, by the predetermined coefficient (for example 0.5). In this manner, the duty ratio in the dimming table is 80% and the duty ratio indicated by the duty signal transmitted by controller 12 to lighting circuit 13 is 40, which is the case referred to by the aforementioned case where the duty ratio in the dimming table is not the duty ratio indicated by the duty signal transmitted by controller 12 to lighting circuit 13.

In this manner, controller 12 causes lighting circuit 13 to control the dimming of light source 20 using a dimming rate that is in accordance with the multiplication of the information based on the dimming signal and the predetermined coefficient.

Meanwhile, as illustrated in FIG. 1, dimming signal converter 14 and parameter signal converter 15 provided in parallel with each other, are present between terminal 11 and controller 12. In the case where luminaire 1 does not include blocker 16, the predetermined signal is inputted to parameter signal converter 15.

Figure 4:
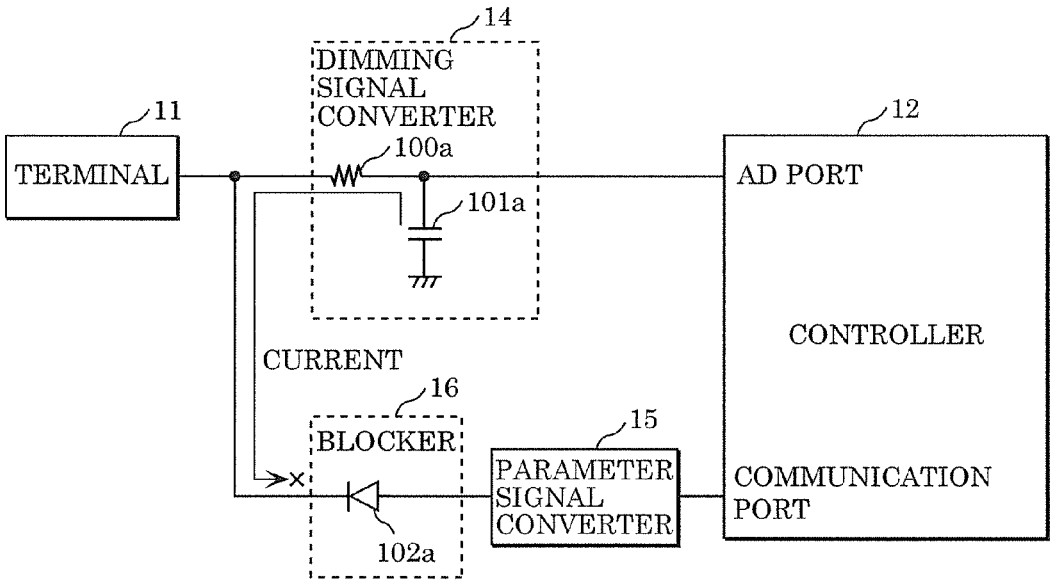
FIG. 4 is a diagram for describing the operation of a blocker according to the embodiment in the case where the blocker is a rectifier.
Figure 5:
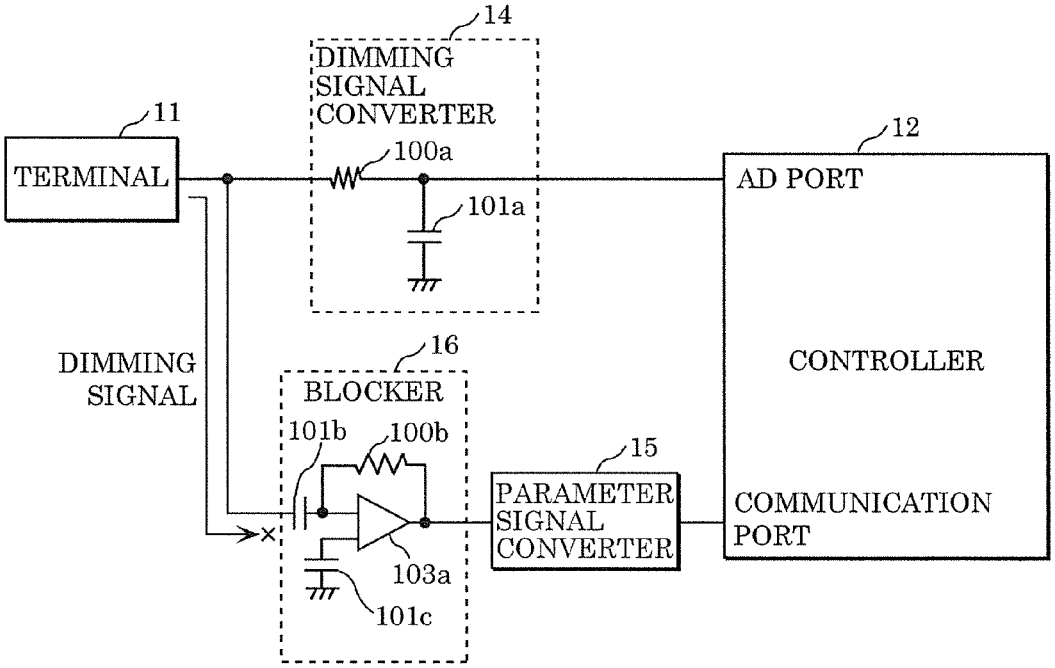
FIG. 5 is a diagram for describing the operation of the blocker according to the embodiment in the case where the blocker is a filter.

For example, in the case where terminal 11 receives a dimming signal when luminaire 1 does not include blocker 16, a current, as the predetermined signal, flows from dimming signal converter 14 to parameter signal converter 15. As illustrated in FIG. 4 and FIG. 5 to be described later, dimming signal converter 14 includes an RC circuit, and an analog voltage that is in accordance with the charge accumulated in a capacitor in the RC circuit is inputted to the AD port of controller 12. However, because the current flows from dimming signal converter 14 to parameter signal converter 15, the value of the analog voltage does not stabilize. Specifically, controller 12 is not able to correctly recognize the dimming rate indicated by the dimming signal transmitted by controller 30. For example, controller 12 mistakes a 20% dimming rate indicated by the dimming signal for a 40% dimming rate, etc.

Furthermore, for example, in the case where terminal 11 receives a dimming signal when luminaire 1 does not include blocker 16, the dimming signal, as the predetermined signal, is inputted from dimming signal converter 14 to parameter signal converter 15. Accordingly, controller 12 mistakes the dimming signal inputted to the communication port of controller 12 for a parameter signal.

In view of this, luminaire 1 includes blocker 16. Blocker 16 will be described using FIG. 4 and FIG. 5.

FIG. 4 is a diagram for describing the operation of blocker 16 according to this embodiment when blocker 16 includes rectifier 102*a*.

Blocker 16 is a circuit that blocks a predetermined signal headed to parameter signal converter 15, and includes, for example, rectifier 102*a* (diode). Specifically, blocker 16 includes rectifier 102*a* which blocks, as the predetermined signal, a current that flows from dimming signal converter 14 (RC circuit including resistor 100*a* and capacitor 101*a*) to parameter signal converter 15. As illustrated in FIG. 4, since the current that flows from capacitor 101*a* of dimming signal converter 14 to parameter signal converter 15 is blocked by rectifier 102*a*, the analog voltage inputted to the AD port of controller 12 stabilizes, and controller 12 is able to correctly recognize the dimming signal. However, since the dimming signal is also inputted to parameter signal converter 15 when blocker 16 includes rectifier 102*a*, there are cases where controller 12 mistakes the dimming signal inputted to the communication port of controller 12 for a parameter signal.

In view of this, blocker 16 may be, for example, a filter.

FIG. 5 is a diagram for describing the operation of blocker 16 according to this embodiment when blocker 16 is a filter.

Blocker 16 may include a filter that blocks a dimming signal headed to parameter signal converter 15 from terminal 11, as the predetermined signal. FIG. 5 illustrates a low-frequency cutoff filter including resistor 100*b*, capacitors 101*b* and 101*c*, and op-amp 103*a*. In this embodiment, as illustrated in FIG. 2, a dimming signal is a signal having a lower frequency than a parameter signal, and thus the low-frequency cutoff filter is configured to block a dimming signal and allow a parameter signal to pass through. Accordingly, as illustrated in FIG. 5, the dimming signal transmitted from terminal 11 to parameter signal converter 15 is blocked by the low-frequency cutoff filter, and thus controller 12 does not mistake the dimming signal for a parameter signal. Furthermore, even when blocker 16 includes a low-frequency cutoff filter instead of rectifier 102*a*, the current that flows from dimming signal converter 14 to parameter signal converter 15 is blocked by the low-frequency cutoff filter.

In this manner, since blocker 16 blocks the current that flows from dimming signal converter 14 to parameter signal converter 15 or the dimming signal headed to parameter signal converter 15 from terminal 11, controller 12 is able to operate normally.

The setting of the brightness range of luminaire 1 may be performed by further connecting setter 40 to terminal 11 of luminaire 1 after completion of the connection between controller 30 and luminaire 1 in an establishment such as a home or office. In general, as illustrated in FIG. 6, a plurality of luminaires 1*a* to 1*c* are often connected to a single controller 30.

Figures 6, 7:
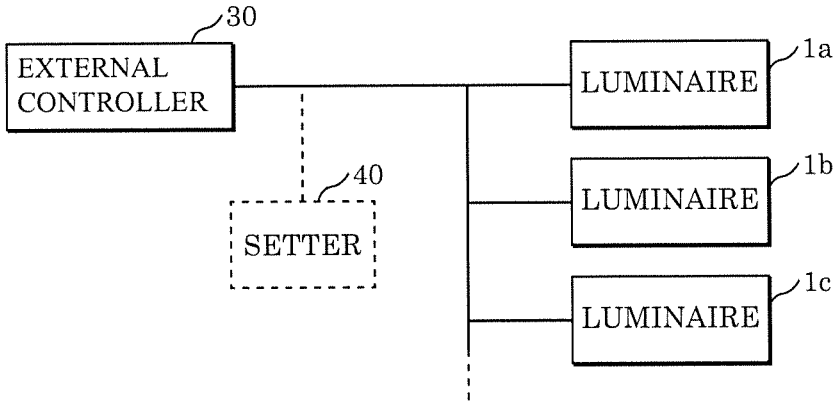
FIG. 6 is a diagram illustrating a state where a plurality of luminaires are connected to a controller.
FIG. 7 is a diagram illustrating an example of information included in a parameter signal.

FIG. 6 is a diagram illustrating a state in which a plurality of luminaires 1*a* to 1*c* are connected to controller 30.

As illustrated in FIG. 6, setter 40 is connected to terminal 11 of each of the plurality of luminaires 1*a* to 1*c* connected to controller 30. In this case, since the respective brightness ranges of luminaires 1*a* to 1*c* are changed collectively when setter 40 transmits a parameter signal, setting a different brightness range to each of the plurality of luminaires 1*a* to 1*c* is difficult.

In view of this, storage 17 stores identification information identifying luminaire 1; and the parameter signal includes a predetermined coefficient and predetermined identification information, as illustrated in FIG. 7.

FIG. 7 is a diagram illustrating an example of information included in a parameter signal.

For example, 1 is stored in storage 17 of luminaire 1*a* as identification information identifying luminaire 1*a*, 2 is stored in storage 17 of luminaire 1*b* as identification information identifying luminaire 1*b*, and 3 is stored in storage 17 of luminaire 1*c* as identification information identifying luminaire 1*c*. It should be noted that the identification information may be a number, etc., including the manufacturing date and serial number. Then, when the identification information stored in storage 17 matches the predetermined identification information included in the parameter signal, controller 12 multiplies the information based on the dimming signal received by terminal 11 by the predetermined coefficient stored in storage 17. For example, when a parameter signal including 1 as the predetermined identification information and 0.5 as the predetermined coefficient is transmitted to luminaires 1*a* to 1*c*, controller 12 of luminaire 1*a* in which 1 is stored in storage 17 as the identification information, stores the coefficient 0.5 included in the parameter signal in storage 17. Even when 1 is received as the predetermined identification by luminaires 1*b* and 1*c* in which 1 is not stored as identification information in storage 17, luminaires 1*b* and 1*c* discard such parameter signal.

Accordingly, even after the completion of the connection between controller 30 and the plurality of luminaires 1*a* to 1*c*, a different brightness range can be set to each of the plurality of luminaires 1*a* to 1*c*.

Advantageous Effects, Etc.

In order to realize a lineup including a plurality of luminaires that output light in mutually different brightness ranges, it is necessary to develop power supply blocks compatible with the brightness range of each of the plurality of luminaires. This increases development workload and complicates power supply block part number management at the manufacturing plant, thus increasing luminaire manufacturing cost.

In view of this, luminaire 1 according to this embodiment includes: light source 20, terminal 11 that receives a dimming signal indicating a dimming rate and a parameter signal including a predetermined coefficient; storage 17 that stores the predetermined coefficient included in the parameter signal received by terminal 11; controller 12 that generates a control value by multiplying information based on the dimming signal received by terminal 11 by the predetermined coefficient stored in storage 17; and lighting circuit 13 that causes light source 20 to output light at a brightness in accordance with the control value provided by controller 12.

Here, the advantageous effects produced by luminaire 1 will be described using FIG. 8.

Figure 8:
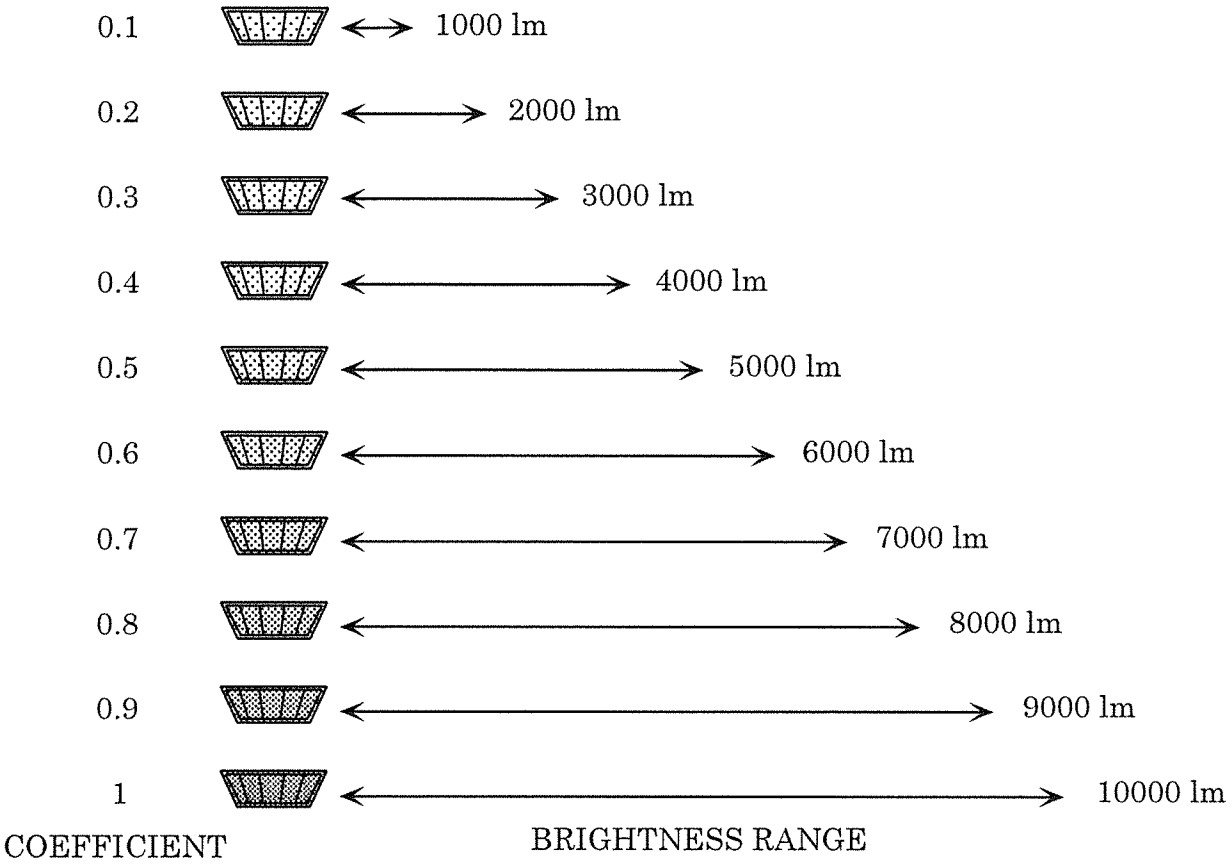
FIG. 8 is a diagram for explaining advantageous effects of the luminaire according to the embodiment.

FIG. 8 is a diagram for explaining the advantageous effects of luminaire 1 according to this embodiment.

For example, as illustrated in FIG. 8, it is assumed that there is a demand that a user wants to select a single luminaire 1 that outputs light in a brightness range that suits the user, from a lineup including a plurality of luminaires 1 having brightness ranges of 0 lm to 1,000 lm, 0 lm to 2,000 lm, . . . , and 0 lm to 10,000 lm. Here, it is sufficient to develop only one type of power supply block 10 (for example, power supply block 10 capable of causing light source 20 of luminaire 1 to output light in a range of 0 lm to 10,000 lm) that includes terminal 11, controller 12, lighting circuit 13, and storage 17, etc. Accordingly, in the case where the user wants a luminaire 1 that outputs light in a brightness range of 0 lm to 5,000 lm, for example, when terminal 11 receives a parameter signal including 0.5 as the predetermined coefficient, controller 12 multiplies the information based on the dimming signal received by terminal 11 by 0.5, and luminaire 1 outputs light in a brightness range of 0 lm to 5,000 lm. In other words, when terminal 11 receives a parameter signal including a coefficient that is in accordance with the brightness range desired by the user, the brightness range of the light to be outputted by luminaire 1 can be set to suit the user. Therefore, power supply block 10 can be assigned one part number, and a lineup including a plurality of luminaires that output light in mutually different ranges of brightness can be realized while suppressing the manufacturing cost of luminaire 1.

Furthermore, luminaire 1 distinguishes the dimming signal and the parameter signal based on the frequencies of the dimming signal and the parameter signal.

Accordingly, luminaire 1 can easily distinguish between the dimming signal and the parameter signal which have different frequencies.

Furthermore, luminaire 1 may further include: dimming signal converter 14 which is provided between terminal 11 and controller 12, and includes a smoothing circuit that smoothes the dimming signal; and parameter signal converter 15 which is provided in parallel with dimming signal converter 14, between terminal 11 and controller 12, and includes a switching circuit that switches according to the parameter signal.

Accordingly, it becomes possible for controller 12 to obtain the dimming signal and the parameter signal even if the dimming signal and the parameter signal are signals that cannot be obtained (cannot be handled) by controller 12.

Furthermore, luminaire 1 may further include blocker 16 provided in parallel with dimming signal converter 14 and in series with parameter signal converter 15, between terminal 11 and parameter signal converter 15. Blocker 16 blocks a predetermined signal heading to parameter signal converter 15.

Accordingly, it is possible to suppress the effect that the inputting of a predetermined signal to parameter signal converter 15 has on the operation of controller 12.

Furthermore, blocker 16 may include rectifier 102*a* that blocks, as the predetermined signal, a current that flows from dimming signal converter 14 to parameter signal converter 15.

Accordingly, since the current that flows from dimming signal converter 14 to parameter signal converter 15 is blocked by rectifier 102*a*, the analog voltage obtained from the conversion by dimming signal converter 14 and inputted to controller 12 becomes stable, and controller 12 is able to correctly recognize the dimming signal.

Furthermore, blocker 16 may include a filter that blocks, as the predetermined signal, the dimming signal headed to parameter signal converter 15 from terminal 11.

Accordingly, in the case where the dimming signal and the parameter signal are signals having mutually different frequencies, including, in blocker 16, a filter that blocks a dimming signal and allows a parameter signal to pass enables the dimming signal headed to parameter signal converter 15 to be blocked. Therefore, controller 12 does not mistake the dimming signal for the parameter signal. Furthermore, when the filter is a low-frequency cutoff filter, the current that flows from dimming signal converter 14 to parameter signal converter 15 is blocked by the low-frequency cutoff filter, and thus the analog voltage obtained from the conversion by dimming signal converter 14 and inputted to controller 12 becomes stable, and controller 12 is able to correctly recognize the dimming signal.

Furthermore, storage 17 may store identification information identifying luminaire 1; and the parameter signal may include predetermined identification information. Controller 12 may multiply the information based on the dimming signal received by terminal 11 by the predetermined coefficient stored in storage 17, when the identification information stored in storage 17 matches the predetermined identification information included in the parameter signal received by terminal 11.

Accordingly, the parameter signal includes, as the predetermined identification information, any one of the identification information stored in respective storages 17 of the plurality of luminaires 1*a* to 1*c*. Therefore, even after controller 30 and the plurality of luminaires 1*a* to 1*c* are connected, it is possible to set different brightness ranges to each of the plurality of luminaires 1*a* to 1*c* in accordance with the predetermined identification information included in the parameter signal.

Other Embodiments

Although luminaire 1 according to an exemplary embodiment has been described thus far, luminaire 1 is not limited to the foregoing embodiment.

For example, although luminaire 1 includes dimming signal converter 14 and parameter signal converter 15 in the foregoing embodiment, luminaire 1 is not limited to such configuration. For example, luminaire 1 need not include dimming signal converter 14 and parameter signal converter 15. However, in this case, the dimming signal and the parameter signal received by terminal 11 need to be signals that can be obtained by controller 12.

Furthermore, for example, although luminaire 1 includes blocker 16 in the foregoing embodiment, luminaire 1 is not limited to such configuration. For example, luminaire 1 need not include blocker 16. However, in this case, for example, terminal 11 includes a first terminal for receiving a dimming signal and a second terminal different from the first terminal, for receiving a parameter signal, and the paths from the respective terminals to control 12 do not meet.

Furthermore, for example, although the dimming signal and the parameter signal are signals having different frequencies in the foregoing embodiment, the dimming signal and the parameter signal are not limited to such signals. For example, the dimming signal and the parameter signal may be signals having the same frequency. However, in this case, in order for controller 12 to distinguish and recognize a dimming signal and a parameter signal, the parameter signal, for example, includes in the header, etc., of the parameter signal, information indicating that the parameter signal is a parameter signal.

Furthermore, for example, although setter 40 transmits the parameter signal in the foregoing embodiment, luminaire 1 is not limited to such a configuration. For example, controller 30 may have the function of setter 40, and controller 30 may transmit the parameter signal.

Furthermore, for example, although the digital values and the duty ratios in the dimming table are in a proportional relation in the foregoing embodiment as illustrated in FIG. 3, their relationship is not limited to such. In general, when brightness changes by the same amount in a state of darkness and a state of brightness, the human eye feels the change in brightness more sensitively in a state of darkness. Therefore, when the digital value is small, the range of increase in duty ratio may be reduced.

Furthermore, for example, controller 12 may change the brightness setting by changing the dimming table by multiplying the duty ratios in the dimming table by a predetermined coefficient. For example, when the predetermined coefficient is 0.5, each of the duty ratios in the dimming table is changed to a 0.5 fold value. Even in this case, the same advantageous effects can be obtained as when the information based on the dimming signal is multiplied by the predetermined coefficient. However, because it is difficult to further set different brightness ranges when the dimming table is changed, the brightness ranges may be set by multiplying the information based on the dimming signal by the predetermined coefficient instead of by changing the dimming table.

Furthermore, the plurality of structural components included in luminaire 1 according to the foregoing embodiments may be implemented as a large-scale integration (LSI)

circuit which is an integrated circuit (IC). These structural elements may be implemented as separate individual chips, or as a single chip to include all or a part thereof. Furthermore, the integrated circuit is not limited to an LSI, and may be implemented as a dedicated circuit or a general-purpose processor. A programmable Field Programmable Gate Array (FPGA) that can be programmed after manufacturing the LSI or a reconfigurable processor which allows reconfiguration of the connections and settings of circuit cells inside the LSI may be used.

In addition, if circuit integration technology that replaces LSI appears through advancement of semiconductor technology or other derived technology, that technology can naturally be used to carry out circuit integration of the plurality of structural components included in luminaire 1.

While the foregoing has described one or more embodiments and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. A luminaire comprising:

a light source;

a terminal that receives, from outside the luminaire, a dimming signal transmitted by an external controller and a parameter signal transmitted by a setter, wherein the dimming signal indicates a dimming rate and the parameter signal including a predetermined coefficient;

a storage that stores the predetermined coefficient included in the parameter signal received by the terminal;

a controller that generates a control value by multiplying information based on the dimming signal received by the terminal by the predetermined coefficient stored in the storage; and a lighting circuit that causes the light source to output light at a brightness in accordance with the control value provided by the controller.

2. The luminaire according to claim 1, wherein the luminaire distinguishes the dimming signal and the parameter signal based on frequencies of the dimming signal and the parameter signal.

3. The luminaire according to claim 1, further comprising:

a dimming signal converter provided between the terminal and the controller, the dimming signal converter including a smoothing circuit that smoothes the dimming signal; and a parameter signal converter provided in parallel with the dimming signal converter, between the terminal and the controller, the parameter signal converter including a switching circuit that switches according to the parameter signal.

4. The luminaire according to claim 3, further comprising a blocker provided in parallel with the dimming signal converter and in series with the parameter signal converter, the blocker being disposed between the terminal and the parameter signal converter, wherein the blocker blocks a predetermined signal heading to the parameter signal converter.

5. The luminaire according to claim 4, wherein the blocker includes a rectifier that blocks, as the predetermined signal, a current that flows from the dimming signal converter to the parameter signal converter.

6. The luminaire according to claim 4, wherein the blocker includes a filter that blocks, as the predetermined signal, the dimming signal headed to the parameter signal converter from the terminal.

7. The luminaire according to claim 1, wherein the storage stores identification information identifying the luminaire, the parameter signal includes predetermined identification information, and the controller multiplies the information based on the dimming signal received by the terminal by the predetermined coefficient stored in the storage, when the identification information stored in the storage matches the predetermined identification information included in the parameter signal received by the terminal.

* * * * *